United States Patent [19]

Holbein et al.

[11] Patent Number: 4,504,357

[45] Date of Patent: Mar. 12, 1985

[54] SECURITY WITH IDENTIFYING MARKS PRINTED IN THE SUBSTANCE OF A PAPER LAYER

[75] Inventors: Hans-Jürgen Holbein, Munich; Paul Leiderer, Neufahrn; Walter Schneider, Miesbach, all of Fed. Rep. of Germany

[73] Assignee: GAO Gesellschaft fuer Automation und Organisation mbH., Munich, Fed. Rep. of Germany

[21] Appl. No.: 545,498

[22] Filed: Oct. 26, 1983

Related U.S. Application Data

[63] Continuation of Ser. No. 301,093, Sep. 10, 1981, abandoned, which is a continuation of Ser. No. 120,315, Feb. 11, 1980, abandoned.

[30] Foreign Application Priority Data

Feb. 13, 1979 [DE] Fed. Rep. of Germany ..... 2905441

[51] Int. Cl.[3] ..... D21H 5/10

[52] U.S. Cl. ..... 162/123; 162/124; 162/125; 162/134; 162/140; 162/201; 162/202

[58] Field of Search ..... 162/134, 140, 198, 201, 162/252, DIG. 10, DIG. 11, 123, 124, 125, 202, 132, 133

[56] References Cited

U.S. PATENT DOCUMENTS

| | | | |
|---|---|---|---|
| 672,582 | 4/1901 | Affetranger et al. | 162/134 |
| 2,019,845 | 11/1935 | Colbert et al. | 162/134 |
| 2,711,120 | 6/1955 | MacLaurin | 162/134 |

*Primary Examiner*—Peter Chin

*Attorney, Agent, or Firm*—Schwartz, Jeffery, Schwaab, Mack, Blumenthal & Koch

[57] ABSTRACT

A security with a paper substrate which exhibits identifying marks in the form of color patterns. The color patterns are arranged in the substance of the paper substrate in such a manner that the normal structure of the fibres in the substance of the paper layer is not disturbed by the color patterns. In the manufacture of the security, the color pattern is sprayed on to the not yet completely finished non-woven fibre during the formation of the paper sheet, and is preferably sprayed on to a non-woven fibre which is then united to a second non-woven fibre.

8 Claims, 8 Drawing Figures

SECURITY WITH IDENTIFYING MARKS PRINTED IN THE SUBSTANCE OF A PAPER LAYER

This is a continuation of application Ser. No. 301,093, now abandoned filed Sept. 10, 1981, which in turn is a continuation of Ser. No. 120,315 filed Feb. 11, 1980, now abandoned.

BACKGROUND OF THE INVENTION

This invention concerns a security with identifying marks in the form of colour patterns, which are printed in the substance of the paper layer, and a method for manufacturing the same.

In the sense of this invention identity papers, credit cards and documents stand for all kinds of securities, such as banknotes, cheque cards, passports, cheque blanks, share certificates, postage stamps, travel tickets or the like. Hereinafter, the simplified term security paper or security therefore always includes documents of the aforesaid kind.

The aforementioned documents are very valuable and must be capable of identification beyond all doubt with respect to their origin and originality, since their material value is merely a fraction of their trade value. Identification is carried out in many ways including the use of identifying characters or marks specially intended for checking their authenticity. In ideal cases, these identifying marks cannot be copied nor forged, or at least only at great expenditure. The presence of such identifying marks in the manner intended thus vouches for the genuineness of the security paper in question. The more an identifying mark can be described as being "non forgeable" and "not capable of being copied", the greater its value for guaranteeing its authenticity.

Heretofore, such identifying marks have been most valuable which can only be incorporated in the security paper during its manufacture. Examples of such marks are, for instance, watermarks, security threads, chemically reacting additives and mottled fibres. These characteristics or marks are particularly suitable for casual scrutiny of security papers, this being the normal method of checking their authenticity. Although these marks can be detected visually, they provide for a high degree of security because paper provided with them can only be manufactured in expensive machines which are out of the reach of forgers and which are unprofitable for forgery if purchased or copied.

A further enhancement of security can be brought about by incorporating the identifying marks only in exactly defined locations in the paper. Besides the difficulty of producing the identifying mark, a potential forger has then the additional difficulty of incorporating it in an exactly defined location of the paper. This further increases his expenditure and reduces the profitability of the forgery.

For practical purposes, such measures are mostly taken in the case of the manufacture of very valuable securities, such as banknotes. Here, it is usual to place the watermark or security thread in certain locations of the security paper. Moreover, patent literature recites the use of mottled fibres in certain locations, these being, more particularly, in the form of strips.

In contrast to this no attempt has yet succeeded to localise chemicals, dyes or other identifying means in any desired location in the web of paper. Such identifying substances are therefore added either to the paper stuff itself or when its surface is being prepared. Therefore, they are always randomly distributed in the whole of the paper stuff or on the total surface of the paper.

DESCRIPTION OF THE PRIOR ART

More particularly in the case of security papers, which should be capable of being both casually and automatically scrutinised, it is desirable to be able to incorporate identifying marks, such as dyes or chemicals, placed in the paper. Fundamentally, security papers with patterns, which are produced by means of dyes in the substance of the paper layer, are already well-known. British Pat. No. 160, which goes back to 1859, recites the manufacture of a security of this kind in which a first layer of paper pulp is scooped manually with a screen. Then this layer is covered in the screen with a stencil and a dye paste is applied with a brush to the parts left open by the stencil. A second layer of paper pulp is scooped after the removal of the stencil. The sheet produced in this manner is couched, and it reveals a colour pattern in the substance of the paper web. This colour pattern, which is for the most part out of the reach of tampering attempts from the outside, is also visible when the paper is viewed with transmitted light.

A security paper manufactured in this way has, apart from the advantages brought about by completely embedding the pattern in the security, also many grave disdvantages. Thus, its manufacture is very intensive in labour, expensive and it therefore cannot be used for the production of large-scale series because of its manufacture by means of hand-scooping and processing with the aid of stencils. Moreover, the reticulation of the paper layer is impaired in locations where the viscous dye paste is applied. Particularly when large-surface patterns are incorporated in the security paper, this is a noticeable disadvantage since the security paper can be split by delamination, at least in the location of the pattern, with the aid of the methods known to one trained in the art. Therefore, manipulation cannot be eliminated.

A further example for the manufacture of such security paper is recited by German Pat. No. 16,595. This patent describes a security paper comprising two sheets which are glued to each other and which are provided on their inner surfaces with polychromatic print. This paper is intended for cheques and securities. Besides identifying the genuineness of the security paper, this identifying mark also provides for the detection of attemped erasures. If inscriptions above the inner print are erased, paper stuff is necessarily removed, whereby the inner print becomes clearly conspicious and shows the attempted forgery.

Nowadays, a security comprising two glued paper layers fails to meet the demands made on a security paper. It is also too easy to delaminated such papers by chemical or mechanical methods and then to forge them.

An example for the manufacture of paper is also known from German Pat. No. 244,479, in which the marking substances are incorporated in the substance of the paper without any interruption of the manufacturing process.

This patent specification describes a means in which dyed fibres are intersperced between two layers of paper and the two layers are then couched together to form a single-layer paper. The paper machine is embodied as a combination of a Fourdrinier machine with a board machine. A first layer of paper pulp is scooped by means of the Fourdrinier machine and the paper pulp is spread over with dyed fibres while still on the Fourdrinier screen. Then the web covered over with fibres is moved to the screen of the board machine where it is covered with a second layer.

This feature eliminates the aforesaid shortcomings of the known method in which the reticulation of the security paper is disturbed in the locations of the identifying mark. On the other hand, this prior art by no means recites the accurate location of, and defined characterisation with unmistakable identifying marks.

From the state of the art it can be seen that the basic idea of providing the coloured markings in the substance of the paper and that the advantages resulting therefrom have been long known. And there has been no shortage of attempts to use such identifying marks in the automatic manufacture of security paper. However, dispite all these attempts, no method has yet been disclosed in which security paper with the aforesaid identifying marks in the substance of the paper, which are variable with respect to colour and design, can be manufactured in modern manufacturing machines without considerably disturbing the rectification of the fibre.

SUMMARY OF THE INVENTION

It is therefore the object of this invention to recite a security paper, which is provided with an identifying pattern located in the inner substance of the paper, and a method for continuously manufacturing the same. In so doing, the inventive security paper is to be resistant to splitting by delamination in the location of the identifying mark and the identifying pattern is to be capable of being varied to any extent with respect to colour and design during its manufacture.

This object is solved by the features disclosed in the characterising portion of the main claim. Further embodiments of the invention are disclosed in the subclaims.

The spraying on of dyes and pigments so as to obtain a faithful pattern for identifying security papers is already known. By way of example, German laying-open print (Offenlegungsschrift) No. 2,523,112 describes a method in which bank cheques are automatically processed by way of a block code which is imprinted by means of ink jet printers or ink jet printing machines. However, as in all the other known cases, this method also uses the ink jet printer merely to imprint information on the surface of a finished security.

For the first time even, this invention enables the manufacture of a security in which identifying marks, which can be designed as desired and which are continuously variable with respect to shape and colour, can be incorporated in the inner substance of the paper during its manufacture and without the manufacturing process being interrupted, and in which, because of the undisturbed structure of the paper in the location of the identifying marks, subsequent alteration of such identifying marks is impossible without damage being caused to the paper.

These advantages can be obtained, above all for reasons of the following properties of ink jet printers:

1. The inks processed by ink jet printing machines are highly fluid. For this reason, they dye the fibres but in no way impair the rectification of the fibres and thus the homogeneous formation of the layer.
2. Ink jet printing machines do not apply any load to the layer which is still spongy and incapable of bearing mechanical loads.
3. Ink jet printers are high-speed matrix printers which are electronically controlled. For this reason, practically all patterns can be incorporated in the security paper.

BRIEF DESCRIPTION OF THE DRAWINGS

Embodiment examples of the invention will be explained by way of example in the following with reference to the drawing, in which.

DESCRIPTION OF THE PREFERRED EMBODIMENTS

Figure 1:
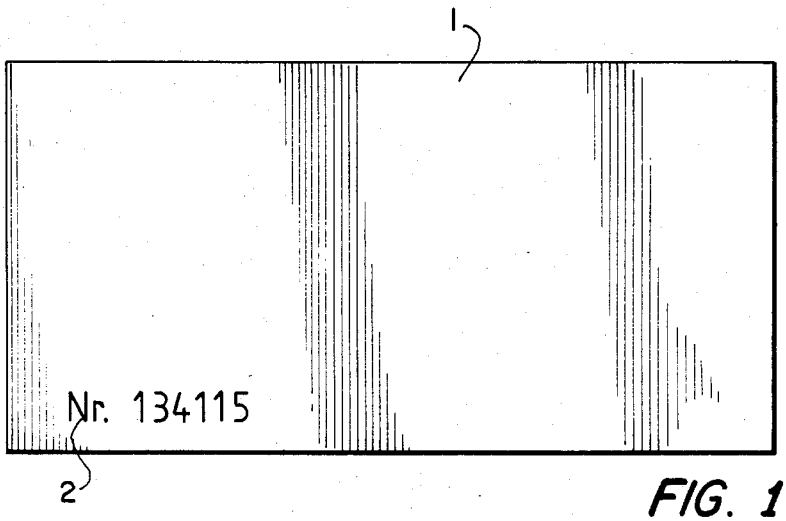
FIG. 1 is a schematic illustration of a security paper with an identifying mark.
Figure 2:
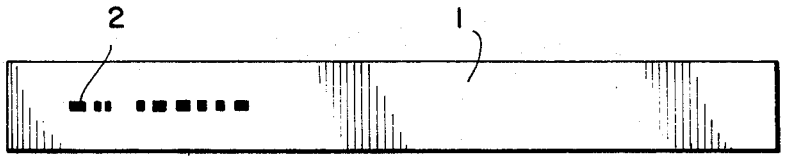
FIG. 2 is a cross-sectional view of the same security paper.

FIG. 1 shows a security 1 in accordance with the invention, in the case of which a serial number can be detected in the lower left corner when viewed with transmitted light. The security, a cross-sectional view of which is shown in FIG. 2, comprises a paper layer which can be scooped in two stages when being manufactured. In the first stage, a partial amount of the paper pulp is scooped and immediately provided with the identifying substance by means of the ink jet printer 4. Subsequently, in the second stage, the paper web is given the desired web thickness and is then drained and couched. The finished security has the identifying substance printed in the substance of the paper, and this identifying substance can be detected by way of its specific visual and/or other physical properties. It cannot be split by delamination, even at the location of the identifying features, because of its homogeneous thread rectification, and it is thus protected in a very special way against forgery attempts.

Figure 3:
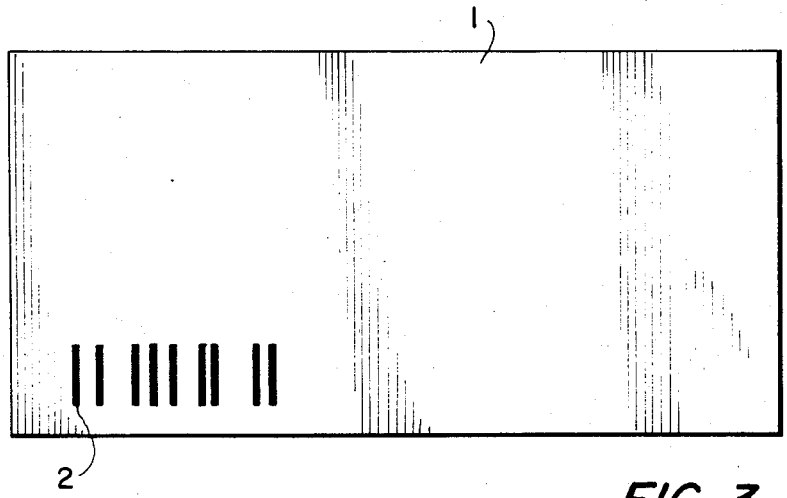
FIG. 3 is a schematic illustration of another embodiment of the security paper with a block code as identifying mark.

The simplest method is to imprint blocks (FIG. 3). In this way, information can be incorporated in the security by way of one of the known codes. Block codes 2*a* are particularly advantageous if the information is to be read by means of ordinary commercial automatic machines. On the other hand, the impression of information on the security is by no means limited to such simple characters when ink jet printers are used.

It is now possible to imprint alphameric characters and other more complicated configurations or patterns by means of ordinary commercial ink jet printers. In this connection, the possibility of individualisation by way of a continuous serial number is of particular interest. In this case use is made of the advantages produced by the control of the ink jet printer by means of electric digital signals. Fundamentally, however, every kind of computer picture can be incorporated as an inner impression in the substance of the paper. An advantageous embodiment is, for instance, the impression of a trade value, since, by way of example, banknotes may be provided with the currency unit and monetary value printed in the substance of the paper.

Figure 4:
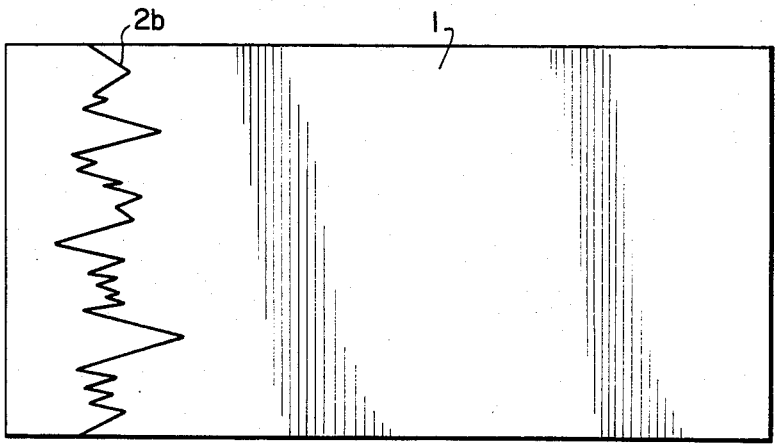
FIG. 4 is a schematic illustration of another embodiment of the security paper with an identifying mark similar to a security thread.

In accordance with a further advantageous embodiment, the identifying mark can also be incorporated in the form of a line which is similar to a security thread. Such a security line 2b is illustrated in FIG. 4, and this security line can, in contrast to ordinary security threads, be of any shape, having, for instance, an undulatory configuration. The novel security line has important advantage over traditional security threads in that it cannot be extracted from the security paper or separated from the paper in any other manner. This line can also be embodied so as to have interruptions or the like, carrying coded information.

It is also possible to provide the ink used for printing with magnetic or electric properties which can be detected with suitable sensors.

Thus, it is completely within the scope of this invention to incorporate a magnetisable or an electrically conductive security line, having any desired configuration, in the thread layer of the security paper. It is equally advantageous to print the identifying mark with fluorescent ink. The aforesaid physical properties permit simple and secure automatic checking of the security paper while, at the same time, coloured inks have the advantage of permitting casual scrutiny of incorporated configurations of patterns.

The decomposition capacity of pattern to be produced by means of ink printers are in the range of tenths of a millimeter, and this enables the production of patterns which are as fine as desired and whose degree of fineness is only limited by the light-dispersing layer of paper.

Figure 5:
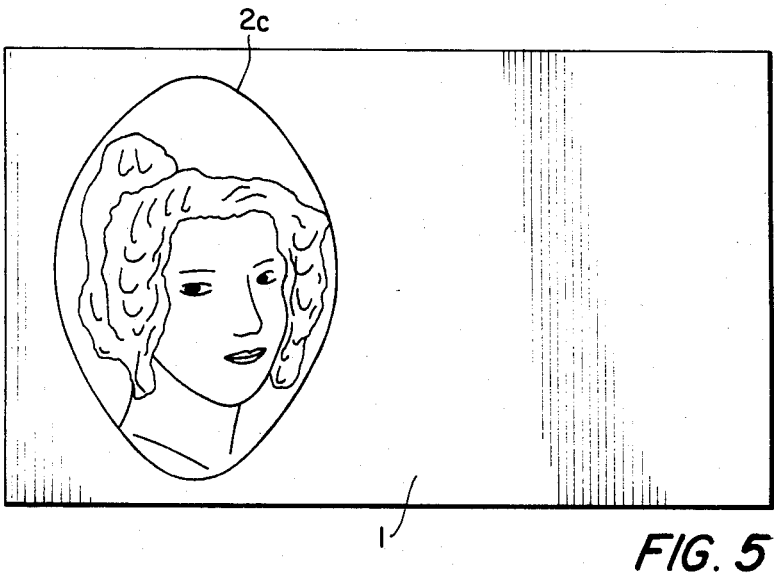
FIG. 5 is a schematic illustration of a further embodiment of a security paper in the case of which a watermark is surrounded by a frame pattern.

The print can also be placed in predetermined locations with equal accuracy. Thus, by way of example, it is possible without any difficulty to mark or accentuate with colour a watermark present in the security paper. FIG. 5 shows a security 1 with watermark 3 which is framed with a dyed inner impression 2c. If technical expenditure is increased and if, in addition, the location of watermark details is determined by means of optical correlation methods or the like, for instance, it is also fundamentally possible to supplement watermarks with an inventive inner impression by appropriate dyeing and thus to enhance its degree of protection. As in the case of other embodiments of the invention, this can basically be carried out both monochromatically and polychromatically.

Figure 6A:
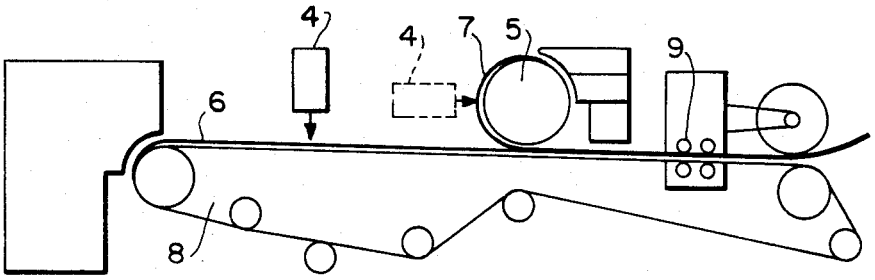
FIGS. 6*a* and 6*b* are schematic drawings of paper machines for the method for manufacturing the security paper.

The manufacture of security paper in accordance with the invention can be carried out in ordinary commercial units, comprising at least two paper machines. A unit of this kind is shown in FIG. 6a. It comprises a Fourdrinier machine 8 with which a first part 6 of the paper web is scooped. The Fourdrinier machine 8 is combined with a board machine 5 by means of which the paper web is given the desired final web thickness. An ink printer 4 is arranged in front of the board machine, over the web. The ink printer 4 presses the web 6 against the supplementary fibre layer 7, either from above or from the side, and its control is timed, for instance, by means of the tone wheel 9 so as to be in synchronism with the transport of the web.

Figure 6B:
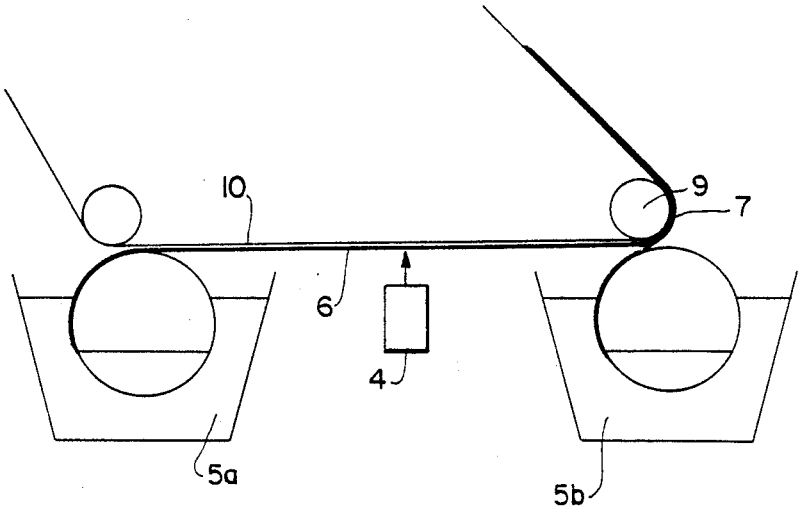

FIG. 6b shows a preferred embodiment of a unit for manufacturing security paper in accordance with the invention. The unit is a combination of two board machines 5a and 5b in which the machine 5a scoops a first part 6 of the paper web which is subsequently passed on through a distance of approximately 2 meters to the second board machine 5b while hanging below the take off felt 10. On its way, it passes the ink printer 4 which in this case does not eject the ink horizontally but vertically upwards instead. The tone wheel 9 synchronises its control.

Fundamentally, all kinds of ink jet recording machines may be used, and these are generally known from data processing and the corresponding technology of high speed printing and recording machines. In practical operation, however, use will not be made in the majority of cases of the more complicated types of ink recording machines with electric control of the ink jet since, on the one hand, the complete technology and the complete repertoire of characters of these recording machines is not required for a large number of applications and since, on the other hand, it may sometimes be necessary to go to great expenditure in the case of the highly developed types because the recorder is operated at a relative ambient humidity amounting to approximately 90%. A further selection criterium is the types of ink used since the synthesis of some of these has to comply with the specific printing mechanism and since the particular application may only permit limited water solubility so that blotting of the ink can be avoided in the paper web which is still wet.

Figure 7:
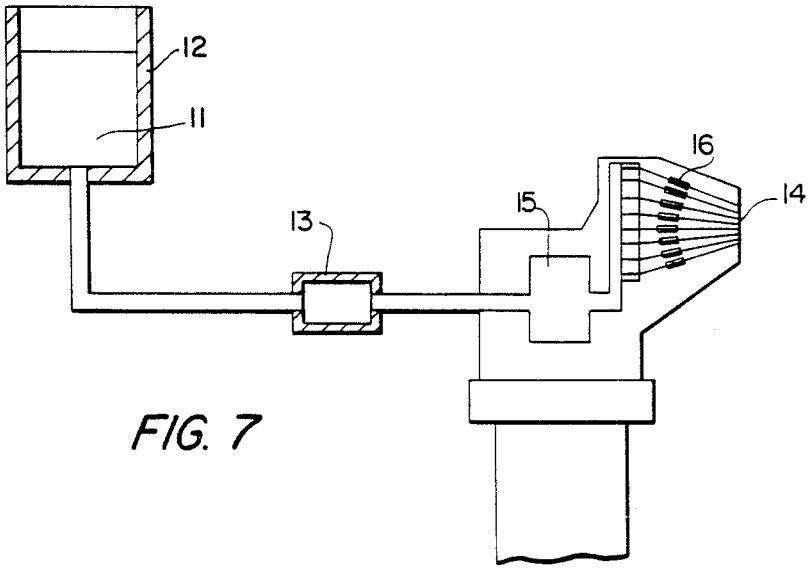
FIG. 7 is a schematic drawing of an ordinary commercial ink jet recording machine which can be used in the manufacturing process for security paper.

A suitable ink printer is the model PT 80 manufactured by the Siemens company. It functions in accordance with the percussion wave principle which is schematically illustrated in FIG. 7. The ink 11 is passed by means of capilliary forces from the tank 12 through the ink filter 13 on to the jets or nozzles 14, without being able to flow out of the latter. This is ensured by the vacuum control system 15. The jets or nozzles are each surrounded by piezoelectric ceramics 16 which can be excited by means of electric signals so as to contract, and this produces the pressure required for ejecting the drops from the nozzles.

Twelve jets or nozzles of this kind are centralised in two rows in the case of the ink printer PT 80. In this printer the height of the rows amounts to 3 mm. A character generator must be provided for cntrolling the ink jet printer, and this may be either simple or complex, depending on the type of pattern or configuration to be printed. The characters may, for instance, be generated in a data processing system. In this case, it is possible to provide the security papers with individual identifying marks, such as for instance by means of a continuous serial number. Ordinary commercial microprocessor systems are ideally suitable for this, permitting, as they do, character variation in a relatively simple manner.

The localised incorporation of the characters is carried out by synchronising the printer with the web feed, which can be carried out in different ways. By way of example, it is possible to collect signals in the form of a rectangular pulse from the motioned part of the paper producing machine (cylinders, press rolls or the like) and to use these for timing the recording machine. Moreover, it is possible to incorporate identifying marks in the paper web while it is still in production, whereby direct synchronisation between the web and the recording machine can be achieved. In so doing, the identifying marks are scanned by means of a sensor and the signals from the latter are used for timing the recording operation.

One possible embodiment in the case of paper machines of normal construction is the so-called tone wheel which is a generator for rectangular pulses and which is mounted on the driving shaft of the wet press. These signals are given to a set-back counter which emits the synchronising signal when a given value has been reached. The synchronising signal times the transmission of the control signals, which are collected in the working storage of the character generator, to the recording instrument, thus also timing the printing of the characters. An identifying mark is formed in a reproducible location in the paper web by means of continuous synchronisation with the press roll.

When beginning production, the timing signal must be set at a desired position of the tone wheel and the timing sequence must be predetermined on the set-back counter.

If several recording instruments are operated in synchronism, it is possible to incorporate multi-coloured characters in the security as well as to enlarge the area covered by the identifying mark, without having to reduce the speed of the web.

Particularly when continuously repeated identical characters are used, considerable simplification can be achieved if the embodiments of the bores of the jet or nozzle piece of the ink jet printer is such that the characters to be produced are inflexibly predetermined.

Furthermore, it can be an advantage in certain cases of application to designedly maintain the decomposition capacity at a low level when printing the identifying marks. In this manner, it is possible to produce homogeneous areal inkings which give the impression of paste paints. Such an effect is easy to produce if inks are used which are accordingly water-soluble.

What is claimed is:

1. Method for manufacturing a paper security with identifying marks printed in the substance of the paper comprising:

forming a non-woven wet fibrous web on a continuously working paper making machine from paper pulp;

continuously passing the wet fibrous web while on the paper making machine past an ink jet printer controlled by micro processor;

printing a pattern onto the wet fibrous web with the ink jet printer;

controlling the ink jet printer to print a desired pattern by a micro processor, said micro processor further controlling the ink jet printer to change or vary the printed pattern on the web while the web is continually being formed on the paper making machine;

adjusting said fibrous web to a desired thickness by adding an additional layer of non-woven fibers to the printed surface of the wet fibrous web on the paper making machine; and draining, couching and drying said web of desired thickness.

2. The method of claim 1, wherein the ink jet printer is a matrix printer.

3. The method of claim 1, wherein the pattern is applied between the screens of a multiscreen paper machine.

4. The method of claim 1, wherein the ink jet printer is moved perpendicular to the direction of transport of the non-woven fibrous web and a dye solution is applied to said web by said ink jet printer.

5. The method of claim 1, wherein said pattern is formed from a material selected from the group consisting of fluorescent, magnetic and electrically conductive materials and mixtures thereof.

6. The method of claim 1, wherein said pattern displays the form of a block code or of the form of alphanumeric characters.

7. The method of claim 1, wherein said pattern comprises a serial number.

8. The method of claim 1, wherein said pattern contains coded information by way of interruptions and/or geometric designs.

* * * * *